US011290806B2

(12) United States Patent
Meng et al.

(10) Patent No.: US 11,290,806 B2
(45) Date of Patent: Mar. 29, 2022

(54) SOUND GENERATING DEVICE

(71) Applicant: AAC Technologies Pte. Ltd., Singapore (SG)

(72) Inventors: Yiming Meng, Shenzhen (CN); Guqing Zhang, Shenzhen (CN); Wei Pang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/996,946

(22) Filed: Aug. 19, 2020

(65) Prior Publication Data

US 2021/0112333 A1 Apr. 15, 2021

(30) Foreign Application Priority Data

Oct. 10, 2019 (CN) ..... 201910960037.1

(51) Int. Cl.
*H04R 7/12* (2006.01)
*H04R 1/28* (2006.01)
*H04R 9/02* (2006.01)

(52) U.S. Cl.
CPC ..... *H04R 1/2834* (2013.01); *H04R 7/127* (2013.01); *H04R 9/025* (2013.01)

(58) Field of Classification Search
CPC ..... H04R 7/12; H04R 7/122; H04R 7/125; H04R 7/127
USPC ..... 381/430
See application file for complete search history.

(56) References Cited

U.S. PATENT DOCUMENTS

| | | | | |
|---|---|---|---|---|
| 3,935,400 | A * | 1/1976 | Koga | H04R 7/127 381/430 |
| 11,197,089 | B2 * | 12/2021 | Meng | H04R 9/025 |
| 2005/0259843 | A1 * | 11/2005 | Horigome | H04R 7/127 381/430 |
| 2006/0072777 | A1 * | 4/2006 | Ohashi | H04R 7/18 381/430 |
| 2014/0079258 | A1 * | 3/2014 | Fujise | H04R 9/06 381/430 |
| 2016/0044418 | A1 * | 2/2016 | Little | H04R 31/003 381/430 |

* cited by examiner

*Primary Examiner* — Suhan Ni
(74) *Attorney, Agent, or Firm* — W&G Law Group

(57) ABSTRACT

The present disclosure provides a sound generating device, which includes a frame, a vibration system, and a magnetic circuit system. The vibration system includes a membrane and a dome. The membrane includes a vibrating part, a suspension, a fixing part, and a first through hole, the frame, the membrane, and the magnetic circuit system form an inner sound cavity communicated with the first through hole. The dome is fixed to the vibrating part, and includes a first body layer, a second body layer, and an air-permeable isolating piece sandwiched between the first body layer and the second body layer. The first body layer defines a second through hole communicating with the first through hole, the second body layer defines a third through hole communicating with the second through hole. The air-permeable isolating piece covers the second through hole and the third through hole.

10 Claims, 4 Drawing Sheets

A-A

SOUND GENERATING DEVICE

FIELD OF THE PRESENT DISCLOSURE

The present disclosure relates to an electroacoustic field, and more particularly to a sound generating device applied to a portable electronic product.

DESCRIPTION OF RELATED ART

With the advent of mobile internet era, there are more and more smart mobile devices. Among the smart mobile devices, mobile phones are undoubtedly the most common and portable mobile terminal devices. Sound generating devices for playing sound have been widely used in the smart mobile devices, such as mobile phones.

A sound generating device in a related art includes a frame, a vibration system fixed on the frame, and a magnetic circuit system for driving the vibration system to vibrate and generate sound. The vibration system includes a membrane fixed on the frame and a voice coil for driving the membrane to vibrate, and the frame, the vibration system, and the membrane cooperatively define an inner sound cavity. The magnetic circuit system defines a pressure relief port for communicating the inner sound cavity with outside, and the pressure relief port is configured for balancing an air pressure between an inside of the sound generating device and the outside.

However, in the related art, external foreign matters are prone to block the pressure relief port due to a small size of the pressure relief port, or external liquid may enter into the inner sound cavity of the sound generating device through the pressure relief port, thereby reducing the reliability of vibrating and generating sound of the sound generating device, and resulting in a poor acoustic performance.

Therefore, it is necessary to provide a new sound generating device to solve the above technical problems.

SUMMARY OF THE PRESENT DISCLOSURE

An objective of the present disclosure is to overcome the above technical problem, and to provide a sound generating device with high reliability and good waterproof performance.

In order to achieve the objective, the present disclosure provides a sound generating device, which includes a frame, a vibration system and a magnetic circuit system both fixed on the frame; the vibration system includes a membrane fixed to the frame and a dome attached and fixed to the membrane; the frame, the membrane, and the magnetic circuit system are configured to cooperatively form an inner sound cavity; the membrane includes a vibrating part, a suspension extending from a periphery of the vibrating part, and a fixing part extending bently from the suspension towards the frame, the fixing part is fixed to the frame, and the dome is fixed to the vibrating part; the membrane further includes a first through hole passing through the vibrating part, the first through hole is configured to communicate with the inner sound cavity; the dome includes a first body layer attached and fixed to the vibrating part, a second body layer directly facing with the first body layer, and an air-permeable isolating piece sandwiched between the first body layer and the second body layer, the first body layer defines a second through hole passing through the first body layer, the second through hole is configured to communicate with the first through hole, the second body layer defines a third through hole passing through the second body layer, and the third through hole communicates with the second through hole; the air-permeable isolating piece completely covers the second through hole and the third through hole simultaneously.

In some embodiments, outer peripheries of the first body layer, the air-permeable isolating piece and the second body layer are flush with each other.

In some embodiments, orthographic projections of the third through hole and the second through hole onto the vibrating part are both configured to fall into the first through hole, and to overlap with each other.

In some embodiments, the first through hole is disposed at a geometric center of the vibrating part, the second through hole is disposed at a geometric center of the first body layer, and the third through hole is located at a geometric center of the second body layer.

In some embodiments, the dome is attached to a side of the vibrating part away from the magnetic circuit system.

In some embodiments, the first body layer, the air-permeable isolating piece, and the second body layer are integrated structure.

In some embodiments, the first body layer and the second body layer are made of aluminum alloy, carbon fiber, or stainless steel.

In some embodiments, the sound generating device further includes a front cover fixed on a side of the frame away from the magnetic circuit system, the front cover defining a sound emitting hole passing through the front cover, the front cover, the membrane and the dome being configured to cooperatively form a front sound generating cavity, and the third through hole being configured to communicate with the front sound generating cavity.

In some embodiments, an orthographic projection of the dome onto the front cover along a vibration direction of the membrane is configured to completely fall into the sound emitting hole.

In some embodiments, the magnetic circuit system includes a yoke fixed to a side of the frame away from the membrane, the yoke and the frame are configured to form a leakage channel, and the leakage channel is configured to communicate the inner sound cavity with outside; the sound generating device further includes damping parts respectively fixed to the yoke and the frame, and the damping parts completely cover the leakage channel.

Compared with the related art, the dome of the sound generating device of the present disclosure is designed to include the first body layer, the air-permeable isolating piece, and the second body layer which are stacked with each other. The first body layer defines a second through hole, the second body layer defines a third through hole, and the air-permeable isolating piece completely covers the second through hole and the third through hole simultaneously. As the air-permeable isolating piece has the functions of air permeability and moisture isolation, the dome is waterproof and breathable. The dome is fixedly attached to the vibrating part, meanwhile the second through hole is communicated with the first through hole in the membrane, so as to communicate the outside with the inner sound cavity through the air-permeable isolating piece. While ensuring the functions of air permeability and moisture isolation, the structure also balances the air pressure inside and outside when the sound generating device works, thereby improving the reliability of the sound generating device and optimizing the acoustic performance of the sound generating device.

BRIEF DESCRIPTION OF THE DRAWINGS

In order to explain the technical solutions in the embodiments of the present disclosure more clearly, the drawings used in the description of the embodiments will be briefly introduced below. Obviously, the drawings in the following description are only some embodiments of the present disclosure. For those of ordinary skill in the art, other drawings can be obtained based on these drawings without paying creative labor, wherein.

DETAILED DESCRIPTION OF THE EXEMPLARY EMBODIMENT

The technical solutions in the embodiments of the present disclosure will be described clearly and completely in conjunction with the drawings in the embodiments of the present disclosure. Obviously, the described embodiments are only parts of the embodiments of the present disclosure, but not all of the embodiments. Based on the embodiments of the present disclosure, all other embodiments obtained by those of ordinary skill in the art without creative work fall within the protection scope of the present disclosure.

Figure 1:
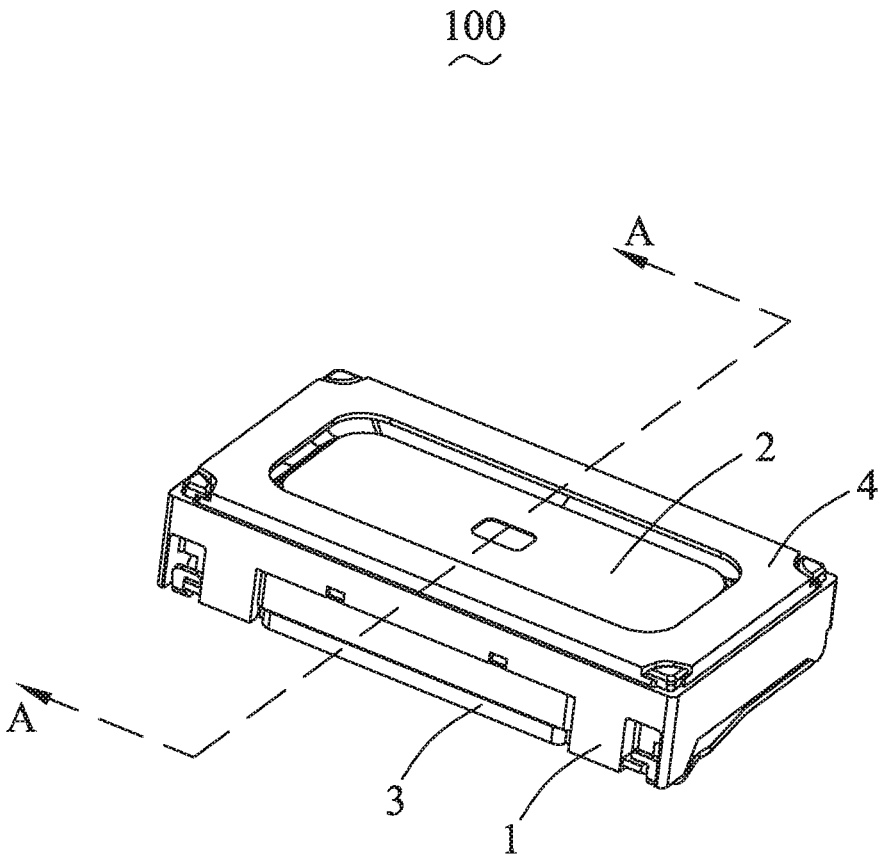
FIG. 1 is a perspective view of a sound generating device of the present disclosure.
Figure 2:
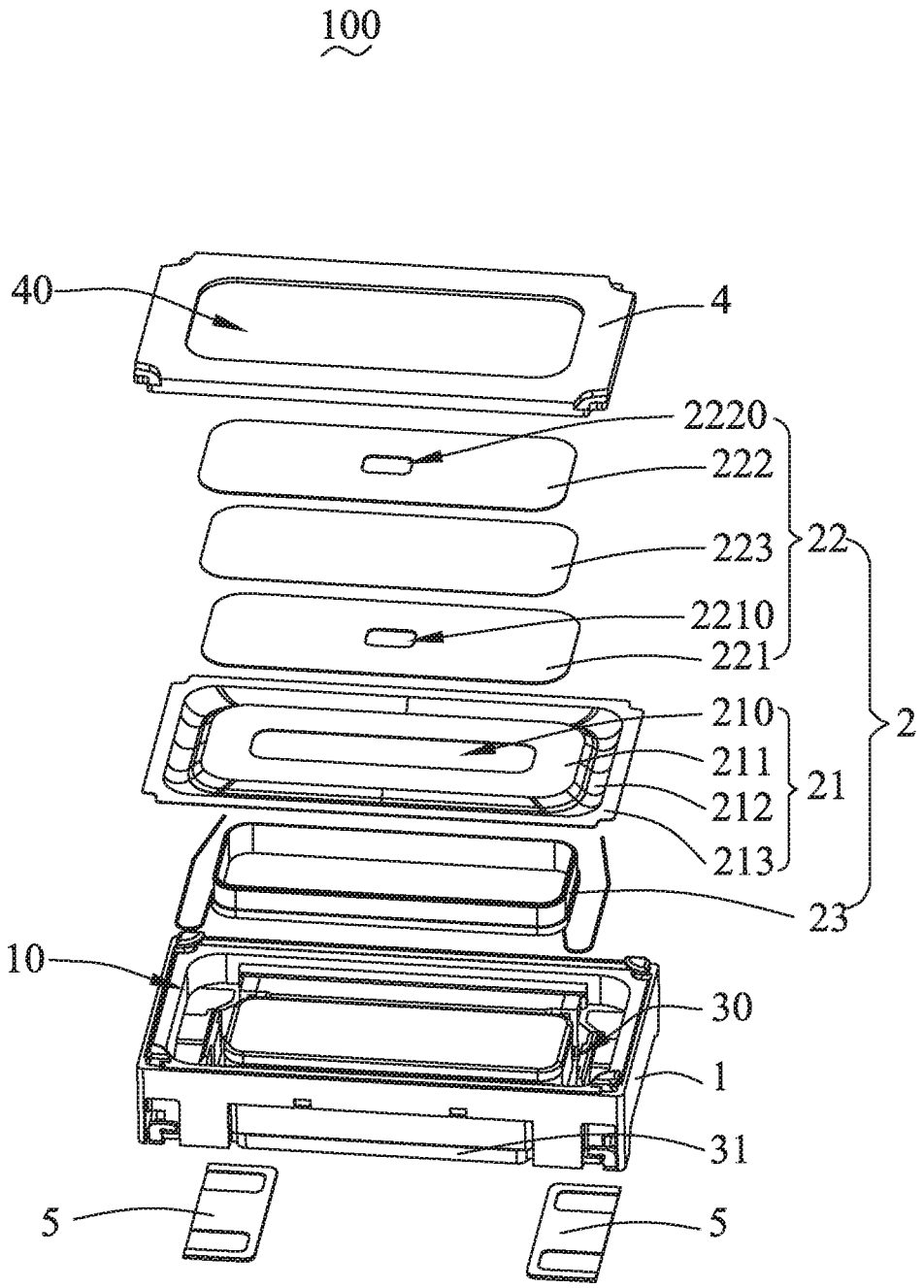
FIG. 2 is a partial exploded view of the sound generating device of the present disclosure.
Figure 3:
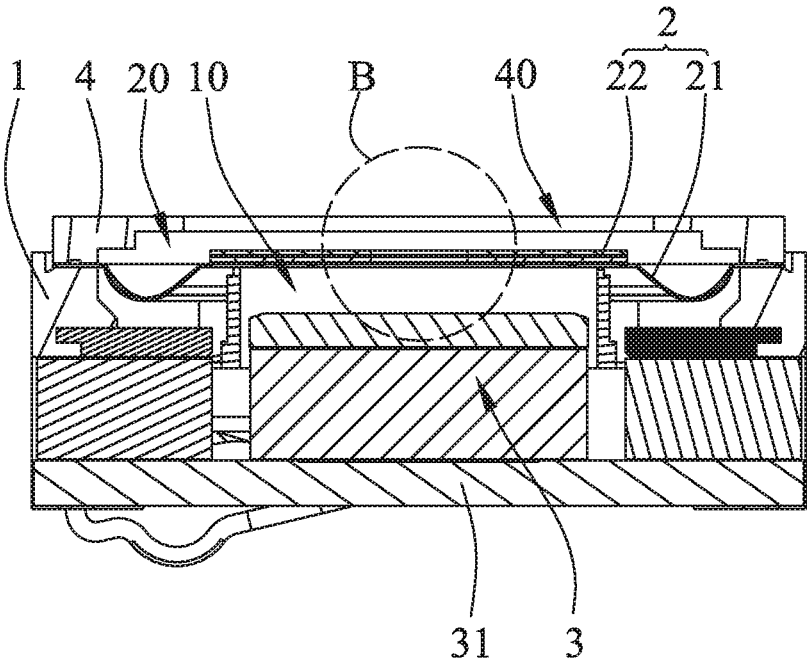
FIG. 3 is a cross sectional view taken along a line A-A in FIG. 1.
Figure 4:
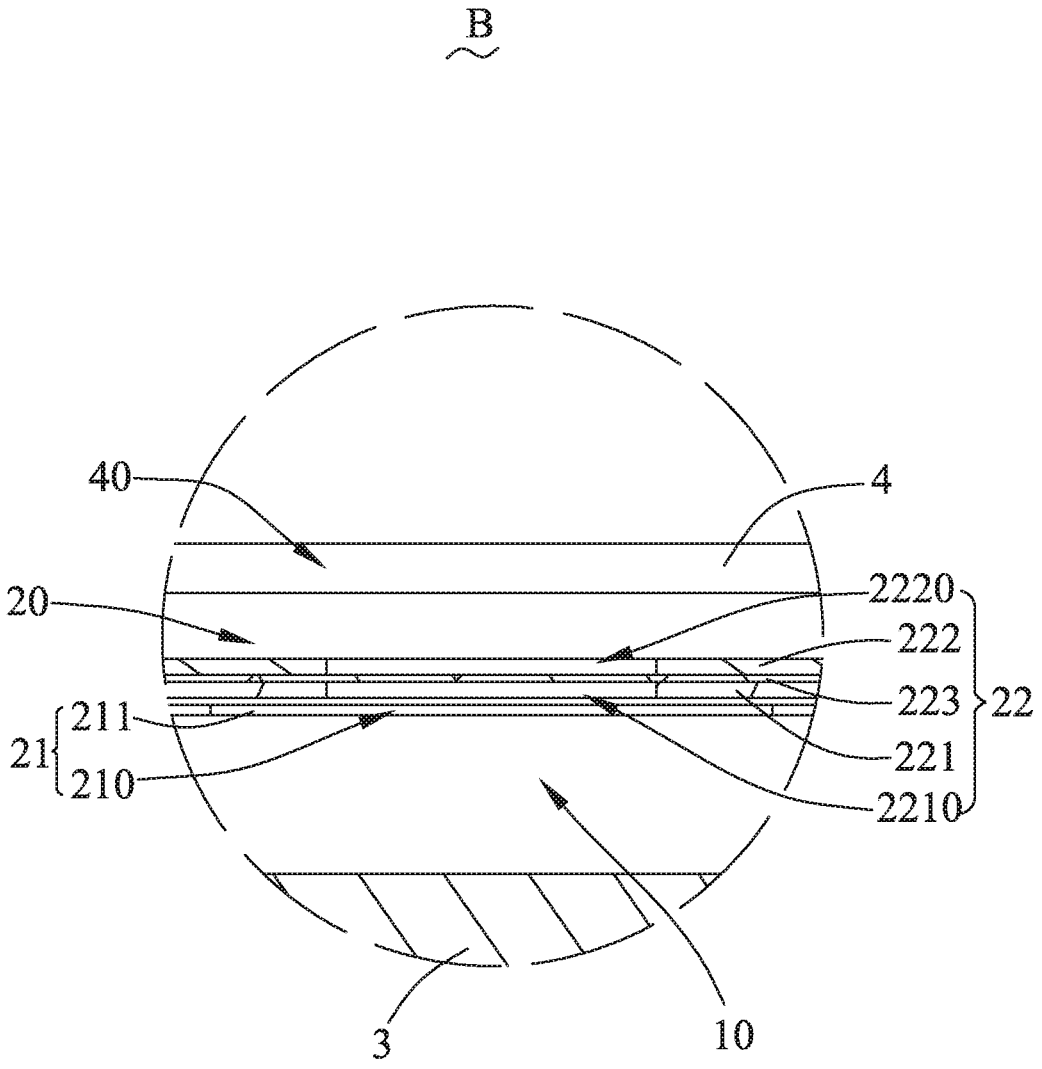
FIG. 4 is an enlarged view of portion B in FIG. 3.

Referring to FIGS. 1 through 4, the present disclosure provides a sound generating device 100, which includes a frame 1, a vibration system 2, and a magnetic circuit system 3. The magnetic circuit system 3 is configured to drive the vibration system 2 to vibrate and generate sound.

The frame 1 is configured to fix the vibration system 2 and the magnetic circuit system 3.

The vibration system 2 includes a membrane 21 fixed to the frame 1, a dome 22 attached and fixed to the membrane 21, and a voice coil 23 for driving the membrane 21 to vibrate and generate sound. The frame 1, the membrane 21, and the magnetic circuit system 3 are configured to cooperatively form an inner sound cavity 10. The voice coil 23 is disposed in the inner sound cavity 10.

The membrane 21 includes a vibrating part 211, a suspension 212, a fixing part 213, and a first through hole 210.

The vibrating part 211 is configured to vibrate and generate sound.

The suspension 212 extends from a periphery of the vibrating part 211.

The fixing part 213 extends bently along a direction from the suspension 212 to the frame 1. The fixing part 213 is fixed to the frame 1.

The first through hole 210 passes through the vibrating part 211. The first through hole 210 is communicated with the inner sound cavity 10.

The dome 22 is attached and fixed to the vibrating part 211. In the exemplary embodiment, the dome 22 is attached and fixed to a side of the vibrating part 211 away from the magnetic circuit system 3. This kind of structure is favorable for maintaining a volume of the inner sound cavity 10 and improving the assembly of the sound generating device 100.

In the exemplary embodiment, the dome 22 covers the first through hole 210. This kind of structure can improve the rigidity of the vibrating part 211 and improve the high-frequency performance of the sound generating device 100.

Specifically, the dome 22 includes a first body layer 221 fixed to the vibrating part 211, a second body layer 222 directly facing with the first body layer 221, and an air-permeable isolating piece 223 sandwiched between the first body layer 221 and the second body layer 222. This kind of structure makes the dome 22 have a composite structure, which is beneficial for fixing the air-permeable isolating piece 223, making the sound generating device 100 easy to be produced, and improving the reliability of the sound generating device 100.

In the exemplary embodiment, outer peripheries of the first body layer 221, the air-permeable isolating piece 223, and the second body layer 222 are flush with each other. This kind of structure is advantageous for assembling the dome 22. As such, the production efficiency of the sound generating device 100 is high.

The air-permeable isolating piece 223 has functions of air permeability and waterproofness.

In the exemplary embodiment, the first body layer 221 defines a second through hole 2210 passing through the first body layer 221, and the second through hole 2210 is communicated with the first through hole 210. The second body layer 222 defines a third through hole 2220 passing through the second body layer 222, and the third through hole 2220 communicates with the second through hole 2210. The air-permeable isolating piece 223 completely covers the second through hole 2210 and the third through hole 2220 simultaneously. In the above structure, air in the inner sound cavity 10 can leak out through the first through hole 210, the second through hole 2210, and the third through hole 2220 in sequence, thus the sound pressure balance between the inner sound cavity 10 of the sound generating device 100 and the outside world is realized, so as to ensure the sound generating device to work smoothly and normally, stabilize its acoustic performance, and improve the reliability of the vibration system 2 when vibrating. In the case of more precise and micro structures, the above mentioned structure can also realize the smooth air leakage of the inner sound cavity 10. The inner sound cavity 10 is air-permeable, and simultaneously its waterproof function can prevent external moisture from entering the inner sound cavity 10 benefit by the air-permeable isolating piece 223, thus the reliability of the sound generating device 100 is improved.

More preferably, in order to better leak the air within the inner sound cavity 10 to achieve an internal and external pressure balance, orthographic projections of the third through hole 2220 and the second through hole 2210 onto the vibrating part 211 respectively fall into the first through hole 210 and overlap with each other. With this structure, the air in the inner sound cavity 10 leaks in a straight direction along the first through hole 210, the second through hole 2210, and the third through hole 2220, thus the air exchange efficiency is high, and the acoustic effect of the sound generating device 100 is better.

In the exemplary embodiment, the first through hole 210 is disposed at a geometric center of the vibrating part 211, the second through hole 2210 is disposed at a geometric center of the first body layer 221, and the third through hole 2220 is located at a geometric center of the second body layer 222. With this structure, the air in the inner sound cavity 10 exchanges with the outside towards the central part, making the air pressure in the inner sound cavity 10 more balanced, so that the acoustic effect of the sound generating device 100 is better.

In the exemplary embodiment, the first body layer 221, the air-permeable isolating piece 223, and the second body layer 222 are integrated structure. The integrated structure is beneficial for improving the production efficiency of the sound generating device 100.

In the exemplary embodiment, the first body layer 221 and the second body layer 222 are made of material with low-density and high-hardness. Specifically, the first body layer 221 and the second body layer 222 are made of aluminum alloy, carbon fiber, or stainless steel. That is, the first body layer 221 and the second body layer 222 are made of at least one of carbon fiber, stainless steel, and aluminum alloy. There are many kinds of aluminum alloys, such as magnesium-aluminum alloy. It should be understood that, the first body layer 221 and the second body layer 222 may be made of some materials, which are not limited to this.

In the exemplary embodiment, the sound generating device 100 further includes a front cover 4 fixed on a side of the frame 1 away from the magnetic circuit system 3. The front cover 4 has a sound emitting hole 40 passing through the front cover 4, and the front cover 4, the membrane 21, and the dome 22 together form a front sound generating cavity 20. The third through hole 2220 is communicated with the front sound generating cavity 20, and the sound emitting hole 40 communicates the inner sound cavity 10 with the outside. This kind of structure is beneficial for transmitting the vibration sound of the membrane 21 to the outside more intensively. The sound emitting hole 40 directly faces with the dome 22. That is, an orthographic projection of the dome 22 onto the front cover 4 along the vibration direction of the membrane 21 completely falls into the sound emitting hole 40. This arrangement makes the acoustic effect of the sound generating device 100 better.

The magnetic circuit system 3 includes a yoke 31 fixed on a side of the frame 1 away from the membrane 21. The yoke 31 and the frame 1 are configured to cooperatively form a leakage channel 30 which communicates the inner sound cavity 10 with the outside. The sound generating device 100 further includes damping parts 5 fixed to the yoke 31 and the frame 1 respectively, and the damping parts 5 cover the leakage channel 30 completely. This kind of structure can also make the air pressure in the inner sound cavity 10 more balanced, thereby improving the acoustic effect of the sound generating device 100.

Compared with the related art, the dome of the sound generating device of the present disclosure is designed to include the first body layer, the air-permeable isolating piece, and the second body layer, which are stacked with each other. The first body layer defines a second through hole, the second body layer defines a third through hole, and the air-permeable isolating piece completely covers the second through hole and the third through hole simultaneously. As the air-permeable isolating piece has the functions of air permeability and moisture isolation, the dome is waterproof and breathable. The dome is fixedly attached to the vibrating part, meanwhile the second through hole communicates with the first through hole in the membrane, so as to communicate the outside with the inner sound cavity through the air-permeable isolating piece. While ensuring the functions of air permeability and moisture isolation, the structure also balances the air pressure inside and outside when the sound generating device works, thereby improving the reliability of the sound generating device and optimizing the acoustic performance of the sound generating device.

The description above is only some embodiments of the present disclosure. It should be pointed out here that for those of ordinary skill in the art, improvements can be made without departing from the inventive concept of the present disclosure, which are all within the scope of the present disclosure.

What is claimed is:

1. A sound generating device, comprising a frame, a vibration system and a magnetic circuit system both fixed on the frame;

the vibration system comprising a membrane fixed to the frame and a dome attached and fixed to the membrane;

the frame, the membrane, and the magnetic circuit system cooperatively form an inner sound cavity;

the membrane comprising a vibrating part, a suspension extending from a periphery of the vibrating part, and a fixing part extending bently from the suspension towards the frame, the fixing part fixed to the frame, and the dome fixed to the vibrating part, wherein the membrane further comprises a first through hole penetrating through the vibrating part, the first through hole communicating with the inner sound cavity;

the dome comprises a first body layer attached to the vibrating part, a second body layer directly facing with the first body layer, and an air-permeable isolating piece sandwiched between the first body layer and the second body layer, the first body layer defining a second through hole passing through the first body layer, the second through hole communicating with the first through hole, the second body layer defining a third through hole penetrating through the second body layer, and the third through hole communicating with the second through hole;

the air-permeable isolating piece completely covers the second through hole and the third through hole simultaneously;

wherein the first body layer and the second body layer are made of material with low-density and high-hardness.

2. The sound generating device according to claim 1, wherein outer peripheries of the first body layer, the air-permeable isolating piece, and the second body layer are flush with each other.

3. The sound generating device according to claim 1, wherein orthographic projections of the third through hole and the second through hole onto the vibrating part are both fall into the first through hole, and overlap with each other.

4. The sound generating device according to claim 3, wherein the first through hole is disposed at a geometric center of the vibrating part, the second through hole is disposed at a geometric center of the first body layer, and the third through hole is disposed at a geometric center of the second body layer.

5. The sound generating device according to claim 1, wherein the dome is attached to a side of the vibrating part away from the magnetic circuit system.

6. The sound generating device according to claim 1, wherein the first body layer, the air-permeable isolating piece, and the second body layer are integrated as one piece.

7. The sound generating device according to claim 1, wherein the first body layer and the second body layer are made of aluminum alloy, carbon fiber, or stainless steel.

8. The sound generating device according to claim 1, further comprising a front cover fixed on a side of the frame away from the magnetic circuit system, the front cover defining a sound emitting hole penetrating through the front cover, the front cover, the membrane and the dome cooperatively form a front sound generating cavity, and the third through hole communicate with the front sound generating cavity.

9. The sound generating device according to claim 8, wherein an orthographic projection of the dome onto the front cover along a vibration direction of the membrane completely falls into the sound emitting hole.

10. The sound generating device according to claim 1, wherein the magnetic circuit system comprises a yoke fixed to a side of the frame away from the membrane, the yoke and the frame form a leakage channel, and the leakage channel being configured to communicate the inner sound cavity with outside; the sound generating device further comprises damping parts respectively fixed to the yoke and the frame, and the damping parts completely cover the leakage channel.

* * * * *